United States Patent [19]

Kallman et al.

[11] Patent Number: 4,897,891

[45] **Date of Patent: * Feb. 6, 1990**

[54] DUST RUFFLES FOR A BED WITH AN IMPROVED FASTENER SYSTEM

[76] Inventors: Robert A. Kallman, 14 Passaic Ave., Apt. 3B, Nutley, N.J. 07110; Mark Henderson, 8 School Ave., Chatham, N.J. 07928

[ * ] Notice: The portion of the term of this patent subsequent to Jan. 10, 2006 has been disclaimed.

[21] Appl. No.: 261,028

[22] Filed: Oct. 21, 1988

Related U.S. Application Data

[63] Continuation-in-part of Ser. No. 114,628, Oct. 28, 1987, Pat. No. 4,796,317.

[51] Int. Cl.[4] ..... A47G 9/04

[52] U.S. Cl. ..... 5/493; 24/72.5

[58] Field of Search ..... 5/493, 496, 498, 482; 24/72.5; 160/330

[56] References Cited

U.S. PATENT DOCUMENTS

| | | | |
|---|---|---|---|
| 524,834 | 8/1894 | Mayent | 24/72.5 |
| 1,147,616 | 7/1915 | Dennison | 5/498 |
| 4,587,683 | 5/1986 | Gardener | 5/493 |

*Primary Examiner*—Alexander Grosz
*Attorney, Agent, or Firm*—Edwin D. Schindler

[57] ABSTRACT

A set of bed dust ruffles, preferably made of cloth, which has along its upper, unruffled border, i.e., perimeter, a mesh or screen is disclosed. The mesh affixed to the ruffles is to be releasably attached to attachment, or fastening, means located on the box spring. Such attachment means, or fastening means, preferably include a sphere or conical head which may be affixed to the box spring or mattress of the bed. The fastening means preferably includes an adhesive layer which contacts the box spring or mattress of the bed, an intermediate foam layer, and an upper layer of, preferably, plastic or other material. The upper layer is to be attached to the head which is to releasably engaged to the flexible mesh of the unruffled poriton of the invention. The preferred fastening means also should include means for permitting the additional engagement of fastening pins, which would penetrate the upper layer, the intermediate form layer, and the lower adhesive layer. The pins, preferably tow pins, are opposed to one another relative to the head of the fastening means, would then penetrate the box spring or mattress.

15 Claims, 4 Drawing Sheets

Fig. 4.
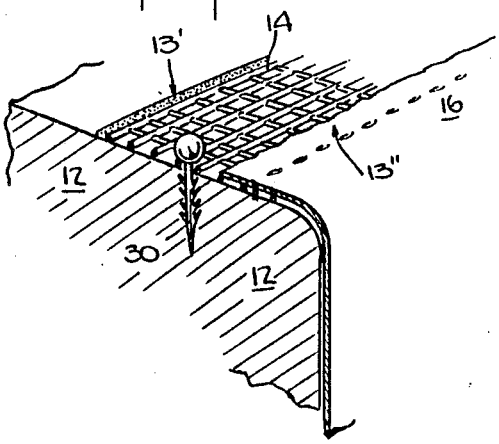
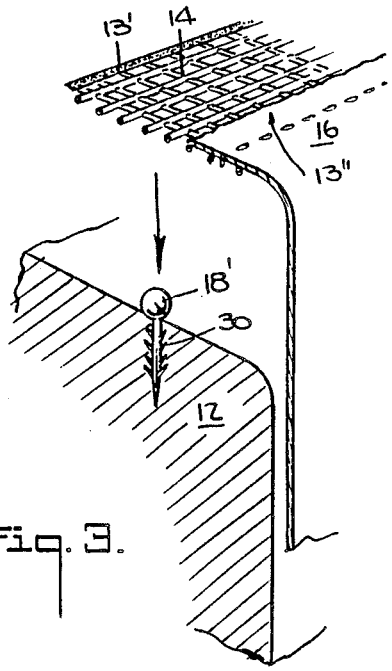
Fig. 3.
Fig. 5.
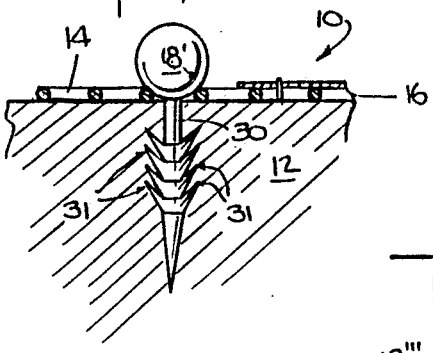
Fig. 6.
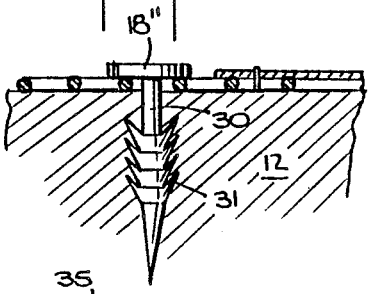
Fig. 7.
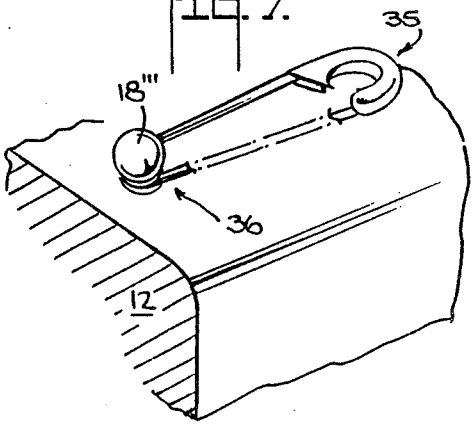

Fig. 8.
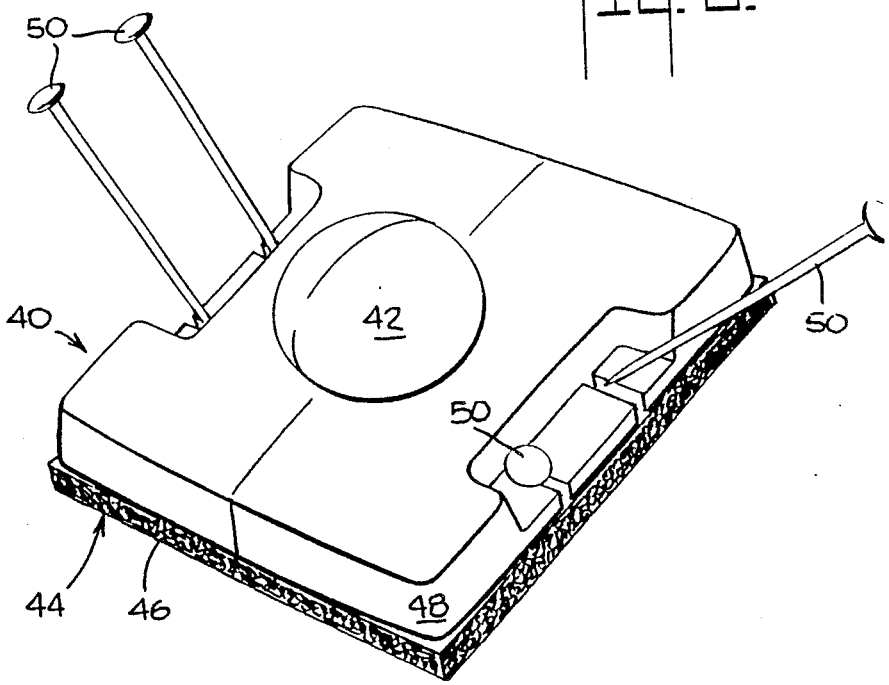
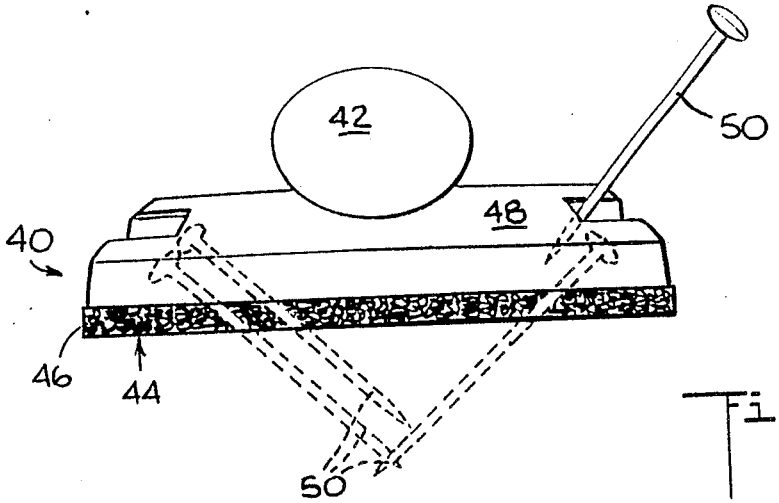
Fig. 9.

Fig. 10.
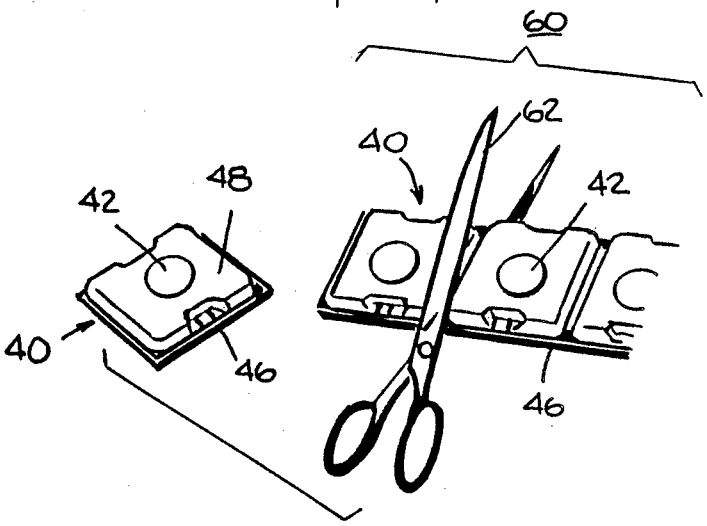
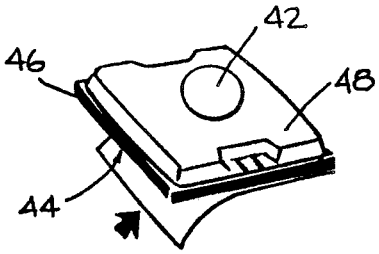
Fig. 11.

DUST RUFFLES FOR A BED WITH AN IMPROVED FASTENER SYSTEM

CROSS-REFERENCE TO RELATED APPLICATION

This application is a continuation-in-part of application Ser. No. 114,628, filed Oct. 28, 1987, now U.S. Pat. No. 4,796,317.

BACKGROUND OF THE INVENTION

1. Field of the Invention

The present invention relates to an improved fastening system for decorative ruffles for a bed. More particularly, the invention relates to a valance, or dust ruffle, for a bed, wherein the dust ruffle is adjustable to any size bed, and without the need of removing the top mattress or otherwise specifically tailoring a particular sized dust ruffle to a particular bed, in which the inventive dust ruffle includes novel fastening means for attachment of the dust ruffle to the bed, e.g., the box spring.

2. Description of the Prior Art

Heretofore, the placement of bed dust ruffles around three sides of a box spring, lying beneath a conventional mattress, normally required the complete removal or displacement of the top mattress from the box spring. The dust ruffles of the prior art were affixed to the perimeter of a sheet. This sheet, of a fixed length and width, had to be properly placed over the box spring. A set of dust ruffles in the prior art device was adaptable to only a mattress of a particular length and width. This is because the length and width of the sheet with the dust ruffles had to match the dimensions of the box spring. Even with a properly sized sheet, the placement of the dust ruffles around the box spring was often quite time consuming and tedious.

Other methods used include a ruffle skirt with an elastic top edge that is held in place by the pressing weight of the mattress. Additionally, the use of safety pins, snaps, corkscrew pins and two-point hook-and-loop type fasteners, such as the ones sold under the trademark of Velcro, are used to position a dust ruffle or top edge around the top of the box spring or foundation. After each of these dust ruffle removals and replacements, careful tedious repositioning and fastening is necessary. Another two-part system in the prior art is disclosed by Gardiner, U.S. Pat. No. 4,587,683, issued May 13, 1986, which uses one part of a zipper along the top edge of the dust ruffle and another around the perimeter of a sized mattress pad. Such zipper systems are very expensive because they require numerous sizes to adjust to the different bed sizes and mattress thickness. Of all the aforesaid prior art devices for the fitting of dust ruffles around a bed, no prior art device offers both an easy and inexpensive method for accomplishing the same.

Representative of the prior art include the patents to Mayent, U.S. Pat. No. 524,834, issued Aug. 21, 1894; Dennison, U.S. Pat. No. 1,147,616, issued July 20, 1915; Hoit, U.S. Pat. No. 1,270,414, issued June 25, 1918; Weinberg, U.S. Pat. No. 2,619,658, issued Dec. 2, 1952; Piontkowski, U.S. Pat. No. 2,763,875, issued Sept. 25, 1956; and, Gardiner, U.S. Pat. No. 4,587,683, issued May 13, 1986.

SUMMARY OF THE INVENTION

Accordingly, it is an object of the present invention to provide bed dust ruffles which are capable of placement along the perimeter of a box spring which may be set in place quickly and conveniently without the need to remove the top mattress from the box spring.

It is a further object of the present invention to provide dust ruffles for a bed which are adjustable to fit box springs or mattresses of greatly varying sizes.

It is, yet, an additional object of the invention to an improved fastening system for attachment of the dust ruffles of the present invention to a bed or box spring.

It is a further object of the present invention to provide a set of bed dust ruffles which is economical to manufacture.

It is an additional object of the present invention to provide decorative dust ruffles which overcome the disadvantages inherent in the prior art.

The foregoing and related objects are accomplished by a set of bed dust ruffles, preferably made of cloth, which has along its upper, unruffled border, i.e., perimeter, a mesh or screen. The mesh is, preferably, made of a durable, but flexible plastic. The mesh affixed to the ruffles is to be releasably attached to attachment, or fastening, means located on the box spring. Such attachment means, or fastening means, preferably include a sphere or conical head which may be affixed to the box spring or mattress of the bed. The fastening means preferably includes an adhesive layer which contacts the box spring or mattress of the bed, an intermediate foam layer, and an upper layer of, preferably, plastic or other material. The upper layer is to be attached to the head which is to releasably engaged to the flexible mesh of the unruffled portion of the invention. The preferred fastening means also should include means for permitting the additional engagement of fastening pins, which would penetrate the upper layer, the intermediate foam layer, and the lower adhesive layer. The pins, preferably two pins, are opposed to one another relative to the head of the fastening means, would then penetrate the box spring or mattress of the invention. The pins would be well secured by the necessary penetration through up to three layers of the fastening means and the penetration into the box spring or mattress of the bed. The pins are, further, used in conjunction with the fastening means of the present invention by a diagonal insertion of said pins in conjunction with the present invention.

When a user wishes to decorate a bed with the dust ruffles of the present invention, a user need simply lift a portion of a top mattress and affix the mesh, having the dust ruffles, to the attachment means which would have been previously secured to the box spring. The mesh would be affixed around, usually, three sides of the perimeter of the box spring. When turning a corner of the box spring, as the user continues to attach the mesh to the means for attachment, the user need only fold-over the mesh, pleating the corner, before continuing to attach the mesh to the box spring in its new 90-degree direction. Alternatively, a new section of the dust ruffle of the present invention may be affixed to another portion of the bed. The precise means for attaching the mesh to a box spring will be explained in greater detail hereinafter by reference to the drawing.

The openings of the mesh, which are preferably attached to the attachment or fastening means of the invention by an interference fit, may exist in rows or columns, which may be diagonally arranged. By preferably, having a plurality of openings in the width of the mesh, it is possible to adjust and re-adjust the height of the dust ruffles to a bed of any height. Of course, a plurality of openings along the width of the mesh is not required if one wishes to design the bed dust ruffles of the invention to a specific height.

The present invention will now be explained in greater detail with reference being made to the accompanying drawing. It should, however, be pointed out that the drawing, while illustrative of the invention, does not define the scope and limitations of the invention.

BRIEF DESCRIPTION OF THE DRAWING

In the drawing, wherein similar reference numerals denote similar features throughout the several views:

FIG. 3 is a perspective view illustrating the mesh of the invention and a preferred means for attachment by a box spring, prior to said attachment;

FIG. 4 is a perspective view showing the mesh of the invention removably attached to a preferred means for attachment of FIG. 3;

FIG. 5 is an elevational view illustrating a preferred means for attachment shown in FIGS. 3 and 4;

FIG. 6 is an elevational view illustrating another preferred means for attachment of the mesh to a box spring;

FIG. 7 is a perspective view of yet another preferred means for attachment of the mesh of the invention to a box spring;

FIG. 8 is a perspective view of yet another preferred means for attachment of the mesh of the invention wherein the mesh is to removably engage the sphere of said attachment means, said attachment means to be either permanently or temporarily attached to a box spring, mattress, etc.;

FIG. 9 is an elevational view of the attachment means, or fastening means, of FIG. 8;

FIG. 10 is a perspective view of the attachment means of FIG. 8 wherein said attachment means are manufactured in a strip which may be cut apart from one another from for eventual use; and, FIG. 11 is a perspective view of the attachment means of FIG. 8 wherein an adhesive, lower layer is exposed following the removal of a protective covering.

DETAILED DESCRIPTION OF THE DRAWING

Figure 1:
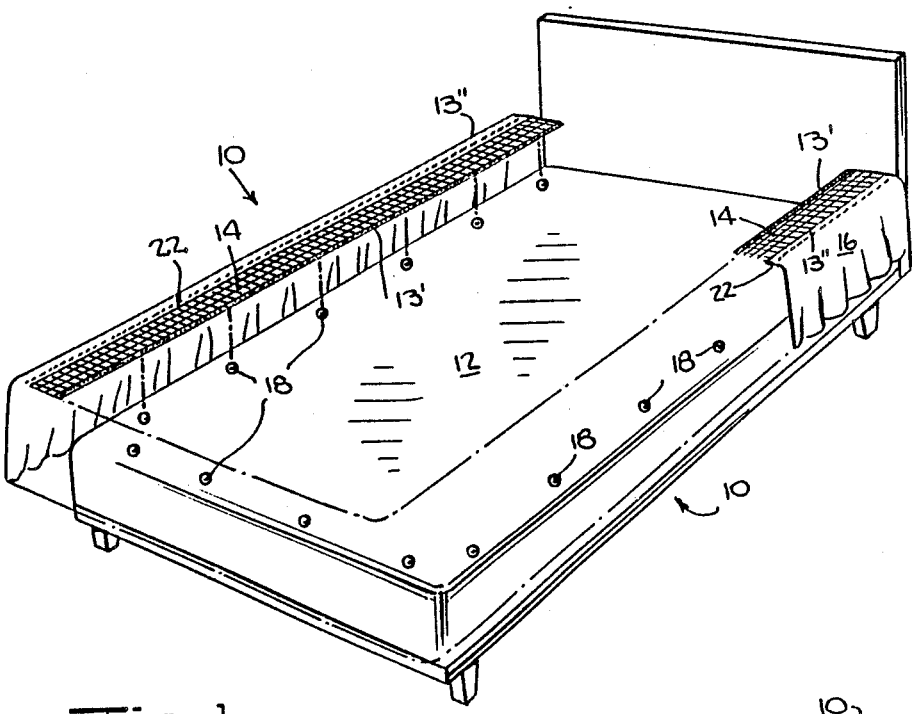
FIG. 1 is a perspective view of a bed with a box spring thereon, illustrating how the mesh, with its dust ruffles, would be attached to an attachment means of the present invention.

Turning now, in detail, to the drawing, FIG. 1 is a perspective view illustrating a bed 10, with box spring 12, and how mesh 14 (partial view), having attached thereto a set of dust ruffles 16, would be placed around bed 10 prior to attachment to attachment means 18. Attachment means 18 may either be permanently or temporarily affixed to either the top, a side or the bottom of box spring 12. Preferably, the means for attachment 18 of mesh 14 is along the top of the box spring 12 in the manner illustrated. It should be pointed out that one may either position the mesh 14 around the edges of box spring 12 or, preferably, attach mesh 14 to box spring 12 via attachment means 18 as one progresses systematically around bed 10 to both position mesh 14 and, concurrently therewith, attach mesh 14 to attachment means 18.

Mesh 14 of the invention is, preferably, a grid, having rows and columns of openings, or diagonally arranged openings, and made of a flexible and, preferably, durable material, which could nevertheless be cut with a pair of scissors. The mesh 14, preferably made of a plastic, is most clearly illustrated in FIGS. 3 and 4. Ruffles 16 are to be attached for the entire length on one side of mesh 14 by conventional means, such as having mesh 14 sewn to, or into upper edge 22 of ruffles 16, or by having mesh 14 glued to dust ruffles 16.

Figure 2:
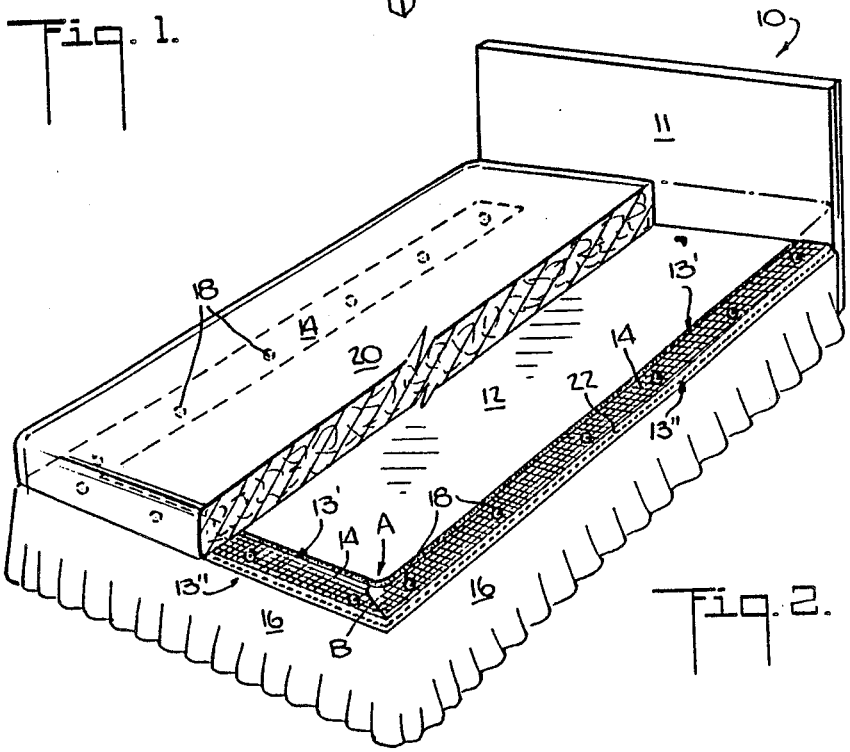
FIG. 2 is a perspective view of the bed and box spring of FIG. 1, following attachment of the mesh of the invention to the attachment means of the invention, with a partial view of a top mattress atop of the box spring.

FIG. 2 is a perspective view showing the attachment of mesh 14 removably attached to attachment means 18 which, in turn, is affixed to box spring 12. A cut-away view of a mattress 20 is presented in FIG. 2. Attachment of mesh 14, with dust ruffles 16, to attachment means 18 is carried out as follows: Initially, one must decide, in view of the height of a bed, the height at which dust ruffles 16 are to be suspended above the ground or floor. Mesh 14, as clearly shown in FIGS. 3 and 4, is a grid, for example, preferably, having columns and rows of openings, or openings which may be diagonally arranged. The rows of the mesh, which arbitrarily run perpendicular to the upper edge 22 of dust ruffles 16, which is attached to mesh 14, preferably have a plurality of openings, e.g., 8–12 openings per row. The columns of openings in mesh 14, for the purposes of discussion, run parallel to the upper edge 22 of the dust ruffles. If one want the dust ruffles of the invention to hang a considerable height down from the top mattress 20 of bed 10, perhaps because bed 10 is relatively large, then one should seek to attach mesh 14 through an opening in a row which is a large number of openings away from upper edge 22. Conversely, if one wishes to have dust ruffles 16 extend, relatively speaking, only a short distance from the top mattress, one should seek attachment of mesh 14 to attachment means 18 at an opening that is relatively close to edge 22 of dust ruffles 16. So that the dust ruffles 16 of the invention are displayed at an even height from the bed, one should seek to attach mesh 14 to attachment means 18 by a series of openings which are all the same number of openings in their respective rows from edge 22.

Actual attachment of mesh 14 to attachment means 18 occurs by pressing or otherwise forcing an opening of mesh 14 over attachment means 18 so that the mesh of the invention is removably affixed to the means for attachment in a fashion somewhat similar to which one buttons a shirt. The use of a spherical or elipsoid shaped head or top distal end provides a simple vertical release or attachment in deference to a flat button-type head which requires complex twisting in order to obtain release or attachment. One would proceed to attach mesh 14 at various points around the perimeter of the box spring 12. Usually, as shown in FIG. 2, one would attach the mesh of the invention around three sides of box spring 12; excluding the side of the box spring which closely parallels the headboard 11 of the bed.

As one proceeds around the bed 10, systematically affixing mesh 14 to attachment means 18, which in turn is affixed to box spring 12, one may freely turn a corner of the bed (A) and simply continue the attachment process. As a result of turning a corner of bed 10, one will find that a triangular segment, designated by the reference letter B, will be formed, i.e., a pleat. This triangular segment may either be left free, to eventually be covered by top mattress 20, or this triangular segment may itself be attached to one of the means for attachment 18. There is no need to cut or otherwise design the dust ruffles of the invention to the length or width of a particular bed. Moreover, when the attachment process around bed 10 is completed, one may either cut the excess portion of the mesh and dust ruffles off, if any, or may simply "backtrack" underneath along the perimeter of the box spring to continue the attachment process until the excess mesh and dust ruffles are fully attached and folded under forming a double layer.

To remove the mesh 14 with ruffles 16 from attachment means 18, one need simply pull, or otherwise apply pressure to the mesh 14 away from the attachment means 18 in order to free the mesh and remove dust ruffles 16 from bed 19.

It should be pointed out that a flexible mesh, as shown in the drawing, is merely the preferred means for carrying out the present invention. In addition, one may employ, instead of a mesh, as an unruffled attachable upper border for the ruffles, a row of buttons.

FIGS. 1–4 also show the preferable inclusion of an anti-sag strip 13' and 13" along the upper and/or lower perimeter, respectively, of mesh 14. The purpose of said strips is to reduce the number of attachment points of the mesh to, for example, the bed.

FIGS. 3–7 show in detail several types of means for attaching (18) mesh 14 to box spring 12. FIGS. 3–5 show a sphere 18' atop of a pointed rod 30 having a plurality of upwardly extending points (31) therefrom. The attachment means (18') shown in FIGS. 3–5 is intended to be permanently embedded into a box spring. Points 31 would make removal of attachment means 18' from box spring 12 extremely difficult. Initially, a user of the present invention would affix the attachment means around the perimeter of a box spring. If the attachment means shown in FIGS. 3–6 are employed, the attachment of the attachment means would likely be permanent. Thereafter, one would temporarily affix mesh 14 to the attachment means by pressing mesh 14 in the manner shown in FIG. 3, with the result thereof shown in FIG. 4. It should be pointed out that the attachment means are preferably affixed to the top side of box spring 12, though, conceivably, they could be affixed along a side of the box spring.

As alluded to above, the attachment means 18' shown in FIG. 6 is of a similar nature to the means shown in FIGS. 3–5, in the sense that it is intended to be permanently embedded into the box spring. Attachment means 18" differs from the means shown in FIGS. 3–5 by having a conventional button, which is to engage the mesh, rather than a sphere. While a button, sphere or any suitable attaching means may be used to engage the mesh 14 to the attachment means, a sphere or slight elipsoid shape is the preferred mode since it has been found to permit the quickest attachment and removal of the mesh from the box spring.

Finally, FIG. 7 illustrates a non-permanent attachment means 35, in the sense that the attachment means shown in FIG. 7 is not intended to be permanently embedded into the box spring 12. Such attachment means 35 is a removable safety pin, having attached (e.g., glued), at its closed end 36, a sphere 18'''. A button (not shown) or any other shaped object for engagement with mesh 14 may be affixed to safety pin 35. In this fashion, this attachment means can be applied to a bed box type foundation, i.e., a foundation utilizing a hard board below a foam and fabric, ticking surface.

Moreover, a safety pin is by no means the only non-permanent mode for affixation of attachment means 18 to mesh 14. A pin, intended for removal, unlike rod 30, may be utilized.

The present mesh fastening system may be also as a means for adjusting attaching drapes rods or curtain rods with spherical fastening means as disclosed herein.

As shown in FIGS. 8–11, attachment means, or fastening means 40, for the dust ruffles of the present invention, preferably include a spherical head 42, one that is conical in shape (or similarly shaped object) which may be affixed to the box spring or mattress of the bed in an arrangement similar to that shown for the attachment means in FIGS. 1 and 2. Fastening means 40 preferably includes an adhesive layer 44 (which is optional) which contacts the box spring or mattress of the bed, an optionally included intermediate foam layer 46, and an upper layer 48 made of, preferably, a plastic material. Upper layer 48 is to be attached to sphere 42 which is to releasably engaged to the flexible mesh of the unruffled portion of the invention. The preferred fastening means also should include means for permitting the additional engagement of fastening pins 50, which would penetrate upper layer 48, the intermediate foam layer 46, and the lower adhesive layer 44. Pins 50 would, preferably, penetrate fastening means 40 via pre-formed openings which, preferably, would further provide an interference fit for pins 50, though the use of an interference fit is optional. Pins 50, preferably two or four pins, positioned opposite to one another relative to sphere 42 of fastening means 40, would then penetrate the box spring or mattress of the invention. Pins 50 would be well secured by the necessary penetration through as many as three layers of the fastening means and the penetration into the box spring or mattress of the bed. Pins 50 are, further, used in conjunction with fastening means 40 of the present invention by a diagonal insertion of said pins in conjunction with the present invention.

It should be pointed out that the use of intermediate foam layer 46 is preferred, though optional in the foregoing fastening means. The omission of such layer 46 has been found to provide substantially similar results to the fastening means including such additional layer.

Finally, the foregoing fastening means 42, is capable of being manufactured in a series of joined components (60) and then detached from one another for use by conventional means, such as, for example, with scissors 62 (note, FIGS. 10 and 11).

While only several embodiments of the present invention have been shown and described, it will be obvious to those skilled in the art that many modifications may be made to the present invention without departing from the spirit and scope thereof.

What is claimed is:

1. A valance for a bed, comprising:

a ruffled portion; and, an unruffled portion attached to said ruffled portion, said unruffled portion comprising a flexible mesh material in combination with fastener means adapted to penetrate the apertures of said flexible mesh material to thereby fasten said valance to portions of said bed, said fastener means including:

a top surface layer of a substantially rigid material; and, a head attached to said top surface layer, said head being capable of penetrating the apertures of said flexible mesh material to fasten said valance to portions of said bed.

2. The valance for a bed according to claim 1, wherein said flexible mesh material is plastic.

3. The valance for a bed according to claim 1, wherein said unruffled portion includes a plurality of spheres attachable to said bed whereby said unruffled portion is capable of removable attachment to said bed.

4. The valance for a bed according to claim 3, wherein said plurality of spheres is permanently attachable to said bed.

5. The valance for a bed according to claim 3, wherein said plurality of spheres is non-permanently attachable to said bed.

6. The valance for a bed according to claim 1, wherein said unruffled portion includes an anti-sag portion which is more rigid than said flexible mesh material.

7. The valance for a bed according to claim 1, wherein said head of said fastening means has a conical shape.

8. The valance for a bed according to claim 1, wherein said head of said fastening means has a substantially spherical shape.

9. The valance for a bed according to claim 1, wherein said top surface layer of material of said fastening means is made of a plastic material.

10. The valance for a bed according to claim 1, wherein said top surface layer of material is an upper layer and said fastening means further comprises a lower layer of material having an adhesive for fastening said fastening means to said bed.

11. The valance for a bed according to claim 10, further comprising a foam layer intermediate between said top surface layer of material and said lower layer.

12. The valance for a bed according to claim 1, wherein said fastening means includes means for attachment to a bed via a plurality of pins.

13. The valance for a bed according to claim 12, wherein said plurality of pins are inserted through preformed openings.

14. The valance for a bed according to claim 13, wherein said plurality of pins are inserted through preformed openings which are shaped for an interference fit with said plurality of pins.

15. The valance for a bed according to claim 1, wherein said head of said fastening means has a substantially oval shape.

* * * * *